US008409038B2

(12) United States Patent
MacDougall

(10) Patent No.: US 8,409,038 B2
(45) **Date of Patent: *Apr. 2, 2013**

(54) BASEBALL BAT

(75) Inventor: John A. MacDougall, Bend, OR (US)

(73) Assignee: MacDougall & Sons Bat Company, LLC, Bend, OR (US)

( * ) Notice: Subject to any disclaimer, the term of this patent is extended or adjusted under 35 U.S.C. 154(b) by 269 days.

This patent is subject to a terminal disclaimer.

(21) Appl. No.: 12/886,813

(22) Filed: Sep. 21, 2010

(65) Prior Publication Data

US 2011/0015008 A1 Jan. 20, 2011

Related U.S. Application Data

(63) Continuation-in-part of application No. 12/460,353, filed on Jul. 17, 2009, now Pat. No. 7,972,229, and a continuation-in-part of application No. 12/724,154, filed on Mar. 15, 2010.

(51) Int. Cl.
*A63B 59/06* (2006.01)

(52) U.S. Cl. ..... 473/564

(58) Field of Classification Search ..... 473/457, 473/519, 520, 564–568; 403/185, 364; 428/163, 428/192; 52/832, 836, 844, 848
See application file for complete search history.

(56) References Cited

U.S. PATENT DOCUMENTS

| | | | | |
|---|---|---|---|---|
| 795,815 | A | 8/1905 | Burrows | |
| 813,400 | A | 2/1906 | Buehler | |
| 1,549,803 | A | 8/1925 | Rastetter | |
| 1,601,915 | A | 10/1926 | Hillerich | |
| 1,706,680 | A | 3/1929 | Smith | |
| 2,017,060 | A | 10/1935 | Hillerich | |
| 2,458,919 | A | 1/1949 | Marsden | |
| 2,848,769 | A * | 8/1958 | Oakley | 52/848 |
| 4,572,508 | A | 2/1986 | You | |
| 4,714,251 | A | 12/1987 | Cook | |
| 5,490,669 | A | 2/1996 | Smart | |
| 5,865,002 | A | 2/1999 | Tapojärvi et al. | |
| 6,007,440 | A | 12/1999 | Bender et al. | |
| 6,010,417 | A | 1/2000 | Young et al. | |
| 6,334,823 | B1 | 1/2002 | Holman | |
| 6,814,113 | B1 | 11/2004 | Daniels | |

(Continued)

OTHER PUBLICATIONS

Graham, Mark S.—Office Action dated Sep. 20, 2011 re U.S. Appl. No. 12/724,154.

Product description and picture of the Viper Bat Company, Inc. 360 Maple Bat characteristics and design, at least as early as Fall 2008, 1 page.

(Continued)

*Primary Examiner* — Mark Graham

(74) *Attorney, Agent, or Firm* — Chernoff Vilhauer McClung & Stenzel, LLP

(57) ABSTRACT

A novel baseball or softball bat is disclosed. The bat has a handle of a heavy, strong wood such as hickory, to resist breakage, and a barrel of a lighter wood such as sapele, to facilitate a controlled and comfortable swing. Methods for making the bat are also disclosed. It may be formed of a plurality of wedge-shaped pieces of wood, and the two species of wood may be joined by interleaving these wedges over part of the bat's length. The interleaving may optionally include a tongue and groove joint or a lap joint for increased strength, and some battens may optionally extend the entire length of the bat.

15 Claims, 7 Drawing Sheets

U.S. PATENT DOCUMENTS

| | | | | |
|---|---|---|---|---|
| 6,827,659 | B1 | 12/2004 | Chen | |
| 7,114,419 | B2 | 10/2006 | Liess | |
| 7,972,229 | B2 * | 7/2011 | MacDougall | 473/564 |
| 2005/0153801 | A1 | 7/2005 | Davis et al. | |
| 2006/0030437 | A1 | 2/2006 | Bao et al. | |
| 2007/0072710 | A1 | 3/2007 | Lo | |
| 2007/0135246 | A1 | 6/2007 | Davis et al. | |
| 2008/0308187 | A1 | 12/2008 | Dill | |
| 2009/0275428 | A1 | 11/2009 | Ikeda et al. | |

OTHER PUBLICATIONS

Product description including pictures of the Radial Bat characteristics and design, at least as early as Fall 2008, 2 pages.

Picture of a Hoosier Woodforce 3000 bat, at least at early as Mar. 2009, 1 page.

Product description and pictures of a Rockbats' All-Wood Laminated Composite Bat "New for 2009," from rockbats.com website, four pages. Actual date of listed art unknown.

* cited by examiner 10
9
9
24
42
26
44
28
34
12a
12b
48
12c
12d
48
30
12
20
18
22
14
32

BASEBALL BAT

This application is a continuation-in-part of U.S. patent application Ser. No. 12/724,154, filed Mar. 15, 2010, and a continuation-in-part of U.S. patent application Ser. No. 12/460,353 filed Jul. 17, 2009.

BACKGROUND OF THE INVENTION

The present invention is related to baseball and softball bats.

SUMMARY OF THE INVENTION

Baseball has been enjoyed by Americans for more than three-quarters of the Union's existence. Although for years technological development was slow, in recent decades the game has been dramatically transformed by changes in bat technology. The introduction of metal and composite materials has changed the game, some would argue for the worse. But it cannot be denied that bats made from materials other than wood have several advantages. They do not break as readily, can have their weight, balance, and feel easily tailored to suit consumer preferences and idiosyncrasies, and are easier for manufacturers to produce with a high level of uniformity because they are not subject to the natural variations of wood. However, there remain many players and fans who prefer wooden bats, and a number of leagues—Major League Baseball being the most prominent—that insist on wooden bats.

The present invention preferably provides a wooden bat that is stronger than those currently available, adjustable at the time of manufacture to give a "custom" combination of weight, balance, and hitting feel, and whose manufacture is subject to quality control in a manner not possible with other bat designs. The bat may optionally be given an appealing and distinctive visual appearance.

Features and advantages of the present invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
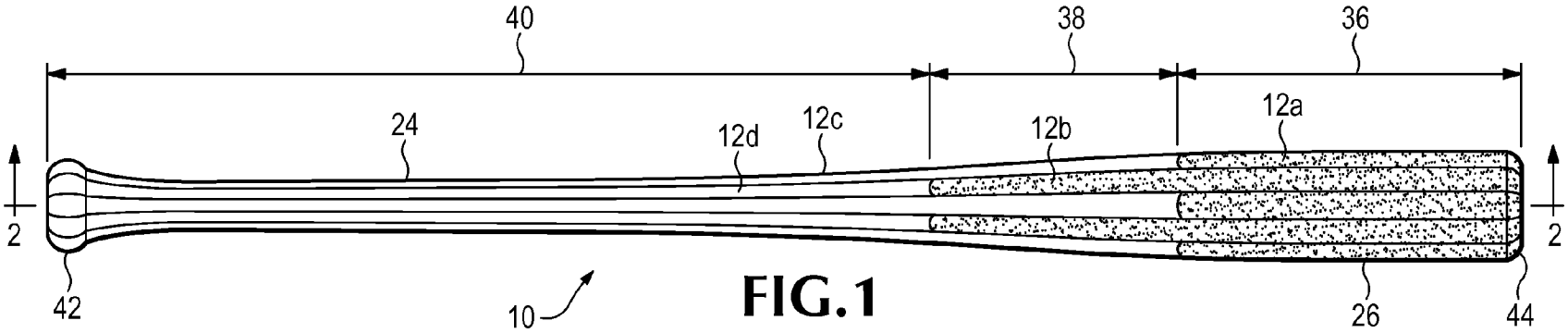
FIG. 1 is an elevation view of an exemplary embodiment of the invention. Because it is cylindrically symmetrical, all elevations will look the same.
Figures 5, 6, 7:
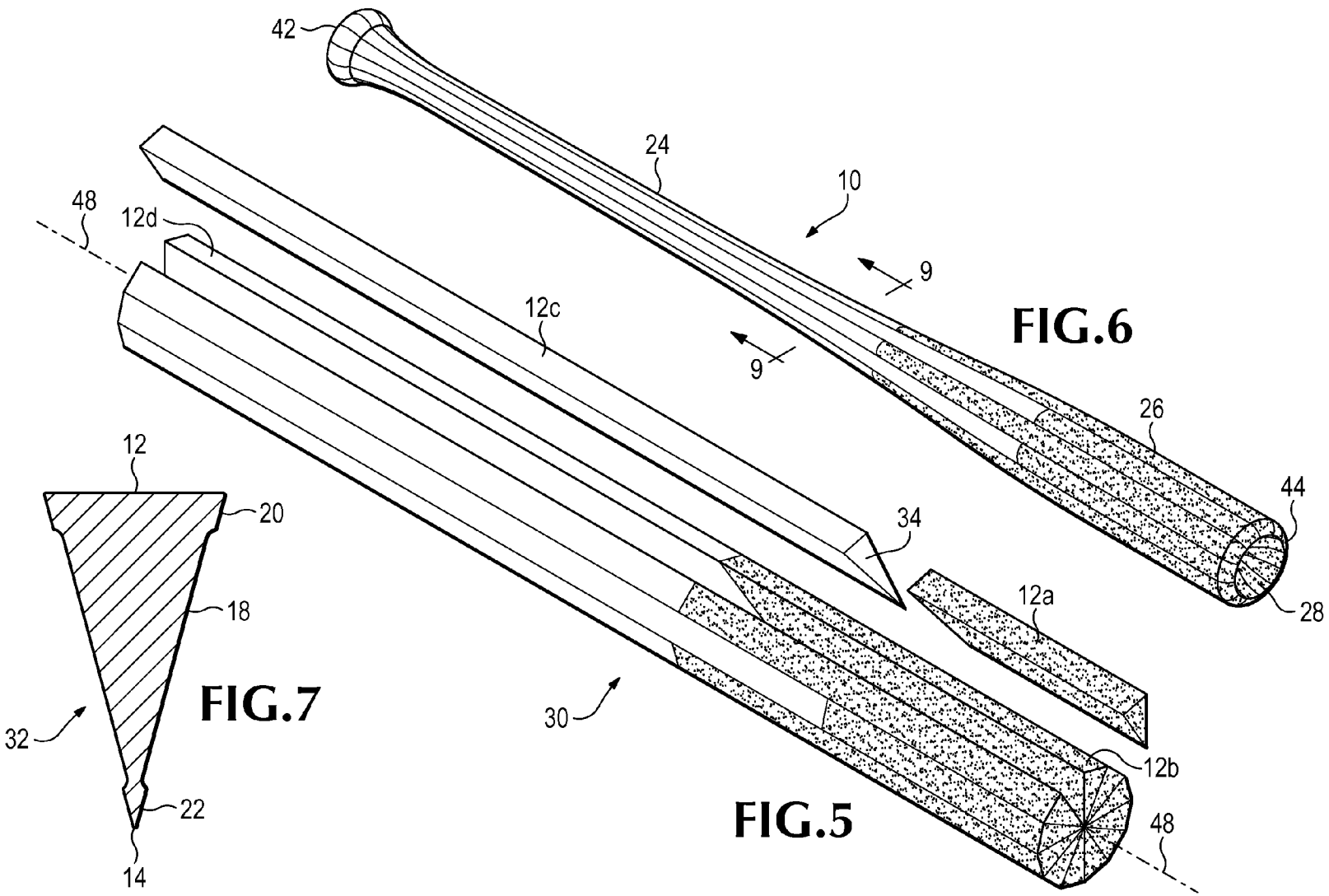
FIG. 5 is a partially exploded perspective view of an approximately cylindrical blank that is to be machined into the exemplary embodiment, showing the composition of the blank and the shape of the battens that make it up.
FIG. 6 is a perspective view of the exemplary embodiment.
FIG. 7 is a cross-sectional view of an exemplary batten, with undercuts made in the sides exaggerated for clarity.

FIG. 1 shows an exemplary embodiment of the present invention. The bat 10 has an outer profile that is ordinary and may be chosen according to the preferences of the player and the rules of the league in which the bat is to be used. The bat is preferably composed of a number of wedge-like upper wooden battens 12*a* and 12*b*, and lower wooden battens 12*c* and 12*d*. These battens 12 are preferably of different lengths, and prior to machining preferably have the form of an elongate triangular prism, as shown in FIGS. 5 and 7. It is also possible to use one set of battens 12, all the same length, which run the whole length of the bat 10.

Figure 9:
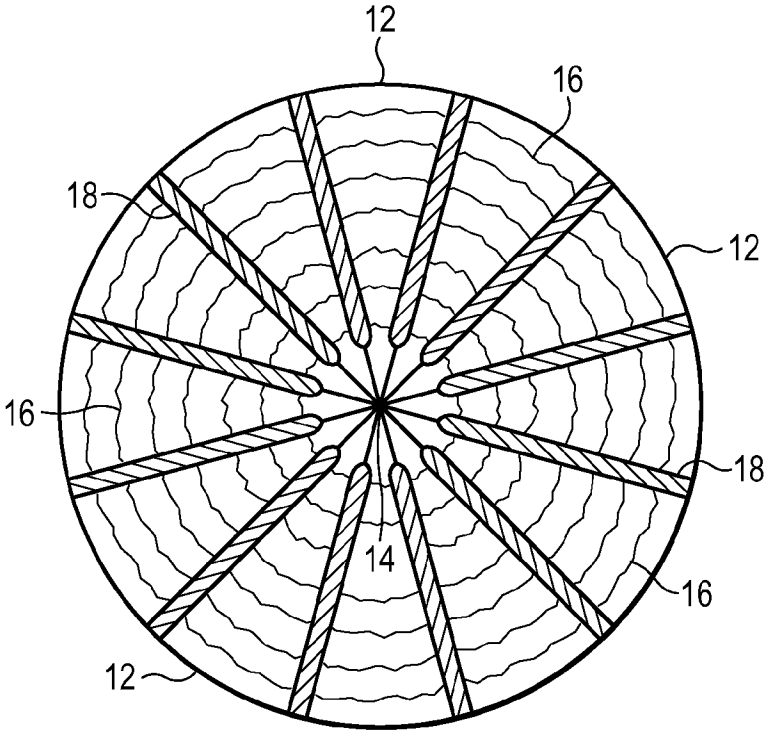
FIG. 9 is a partial cross-section view of FIG. 1 along line 9-9, showing an exemplary embodiment of a wood grain arrangement in battens wherein the grain extends longitudinally along the batten and grain lines travel in a substantially circumferential direction. Glue gaps between the battens have been exaggerated for clarity.
Figure 8:
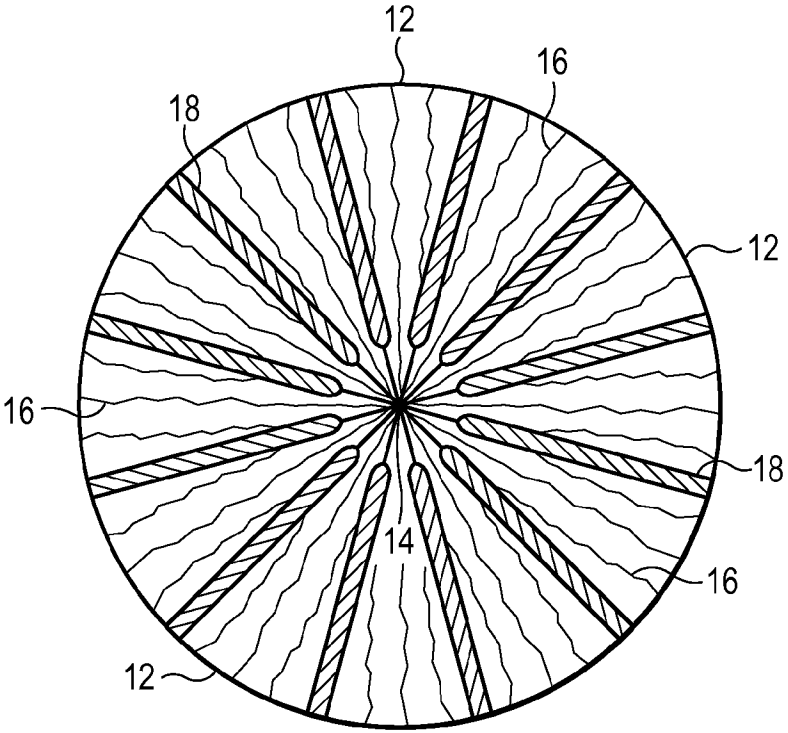
FIG. 8 is a partial cross-section view of FIG. 1 along line 9-9, showing an exemplary embodiment of a wood grain arrangement in battens wherein the grain extends longitudinally along the batten and grain lines travel in a substantially radial direction. Glue gaps between the battens have been exaggerated for clarity.
Figures 10, 11, 12:
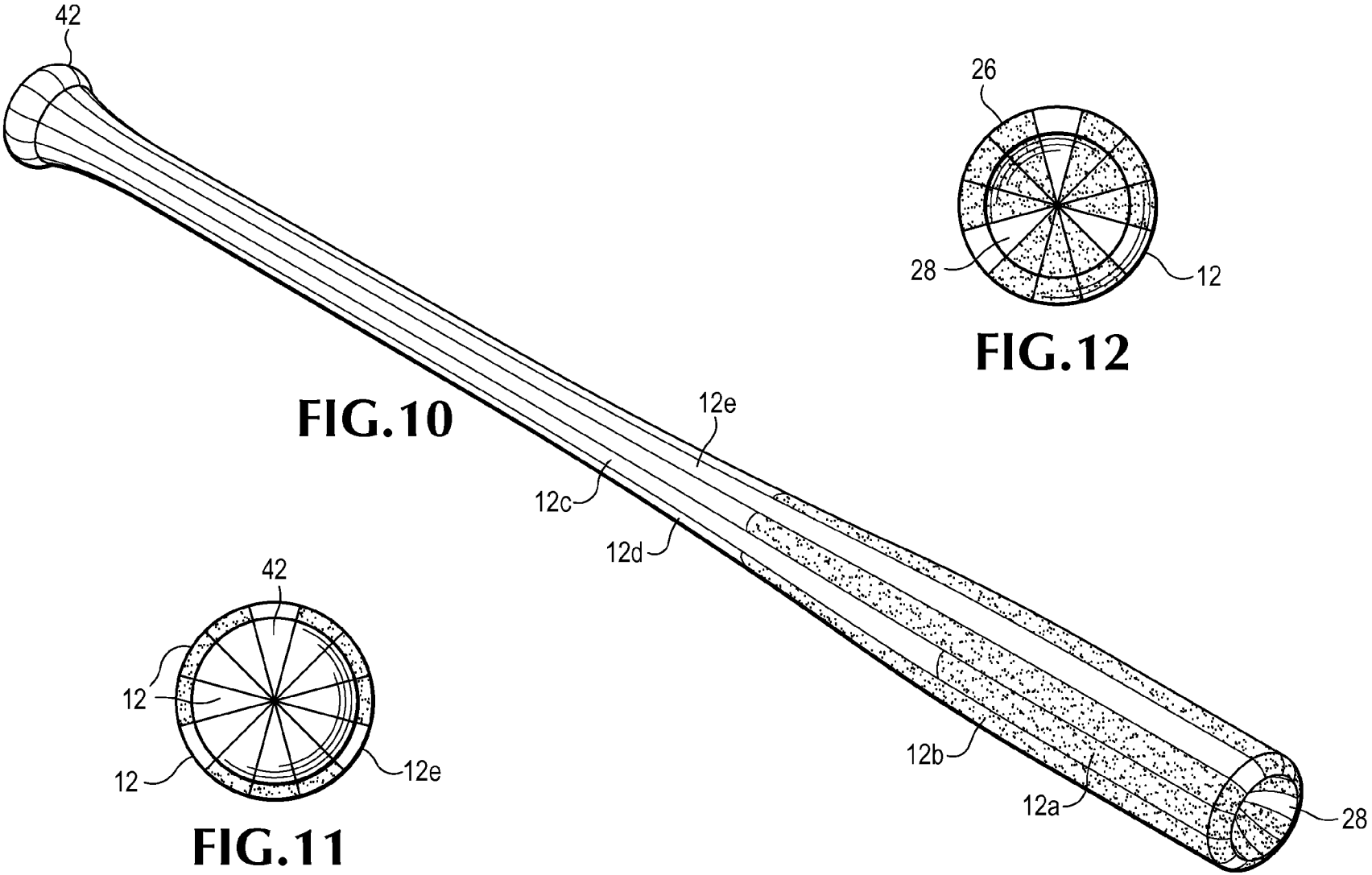
FIG. 10 is a perspective view of an alternative embodiment.
FIG. 11 is a plan view of the bottom, or knob end, of an alternative embodiment.
FIG. 12 is a plan view of the top, or barrel end, of an alternative embodiment.

Regardless of length, the battens 12 may have a vertex 14 that may be cut at any angle that, when added to the angles of the other battens 12, will form a complete circle. Preferably, the number of battens 12 is even, and they are preferably of substantially identical cross-section, although alternate choices are also possible. Preferably, the number of battens 12 is either 8 or 12. Also preferably, the battens 12 are cut so that the grain of the wood runs longitudinally, and the grain lines 16 viewed in cross-section are either substantially radial or substantially circumferential, as shown in FIGS. 8 and 9. Preferably, the grain lines 16 are substantially the same in all battens 12 so as to produce a bat that is substantially cylindrically symmetric.

FIG. 7 is an enlarged cross-sectional view of one of the battens 12. Each batten 12 has two faces 32 adjacent a vertex 14. The center portion 18 of each face 32 may be slightly undercut, while the outer portions 20 and 22 are left undisturbed. Preferably, approximately 4-5 thousandths of an inch of material are removed to form the undercut. This has been exaggerated in the figure for the sake of clarity. When the battens are joined together as depicted in FIG. 5, the outer portions 20 and 22 are permitted to touch or are separated by only a very tiny glue gap, permitting proper alignment of the battens. Between the center portions 18 of two adjacent faces 32, a gap of 8-10 thousandths of an inch is formed. This allows glue to fill the joint for a secure bond, prevents a "starved joint" that lacks sufficient glue, and promotes proper alignment even in cases where the batten was originally formed with slight surface imperfections. Preferably, the center portion 18 is slightly roughened, for example by the use of sandpaper, after the undercut is formed, to promote adhesion of the glue. This may be easily and quickly accomplished by the use of a belt sander with a narrow belt. When the bat is later machined, the outer portion 20 is typically removed over most or all of the bat's length.

The undercutting described above is typically necessary when the glue used to bond the bat comprises a two-part epoxy. The preferred embodiment uses this type of glue, which is strong, waterproof, and can cure without requiring special environmental conditions. This contrasts with carpenter's glue (which requires a dry environment with air circulation) and single-component polyurethane glues (which require moisture). One suitable epoxy is "Gel Magic," manufactured by System Three Resins, Inc. of Auburn, Wash. However, other types of glue may alternatively be used, in which case the undercuts may be not only unnecessary, but undesirable. For instance, carpenter's glue shrinks when curing, which will leave air gaps in any undercuts and be detrimental to the strength of the joint.

The assembly process for bat 10 comprising a single set of full-length battens is straightforward. An appropriate number of battens are selected. The battens are weighed and marked with their weights. Some variation is inevitable with a natural material such as wood. A layout is selected whereby the resulting approximately cylindrical blank 30 is as nearly balanced about its axis 48 as is practical, to minimize vibration during the machining process later. The most convenient way to accomplish this is to select battens for placement on opposite sides of the blank that are as nearly matched in weight as can be achieved from the selected battens. More sophisticated methods may also be employed, such as choosing the weights of neighboring battens to compensate for any remaining imbalance. In addition, the total weight of the bat may be adjusted by selecting different battens for inclusion in the set. In this way, nonuniformities in the wood from various trees may be evened out, resulting in greater bat-to-bat uniformity and improved consistency of performance. Alternatively, variations in total weight may be intentionally introduced in order to offer consumers a choice of bat weights in bats with otherwise identical dimensions. In either case, the manufacturer can exercise greater control over bat weight than is possible when using single-piece wood blanks.

After the battens have been selected for a particular bat, the appropriate glue is applied to their faces 32. The battens are then placed against one another, with the vertices 14 of the battens all meeting in the center at the axis 48 of the blank 30. Care should be taken to make this meeting of the vertices 14 as symmetrical about the axis 48 as possible. When enough battens are in place to form a complete circle, and their alignment has been confirmed to be correct, the entire blank 30 is clamped to allow the glue to cure. This may be accomplished through the use of ordinary steel hose clamps, of the type found in auto parts and hardware stores, encircling the blank 30 perpendicular to and centered on the axis 48. This provides a symmetrical, radially directed force to push the battens towards the axis 48 and therefore into closer contact with one another during curing. The hose clamps may be shielded from contact with glue oozing from the joints between the battens by a barrier wrapped around the assembled blank. The barrier may be any material impervious to the glue, such as polyethylene sheeting or wax paper. Preferably, it is thin and light enough that it has minimal influence on the alignment of the battens 12 and the tension in the hose clamps, and also preferably, it does not stick to the glue being used.

When the glue is cured, the finished blank 30 is released from the clamps and the barrier is removed. The blank 30 may then be machined into its final shape by means that are well known to those skilled in the art. Typically, this is accomplished by turning the blank 30 on a lathe. Preferably, the lathe is automated to minimize the need for human intervention, which is costly and introduces undesirable variation into the manufacturing process. For example, a hydraulic copy lathe may be employed, which adjusts the position of a gouge or other cutting implement based upon a template. CNC techniques or hand-turning are also possible. The final profile of the bat is determined by the rules of the league where the bat 10 is intended to be used, and by consumer preferences. In an exemplary embodiment, a hollow 28 is formed at the end to lighten the bat slightly and adjust the position of the center of gravity 46. The shape of the hollow 28 is also regulated by the rules of the league. After turning, the bat may be sanded and finished as desired.

A single bat may be constructed from two or more different types of wood. Such construction permits the adjustment of the weight, moment of inertia, and location of the center of gravity 46 by selecting woods of different densities and other properties, and adjusting the profile of the bat to best take advantage of these properties. Hickory is strong, so that bats constructed from it are unlikely to break, but it is also heavy, such that an all-hickory bat is difficult to swing accurately, particularly at a breaking ball. Accordingly, the preferred embodiment employs hickory for the battens 12*c* and 12*d* of the handle section 24, which is the most easily broken part, and a less-dense hardwood, for example sapele, for the battens 12*a* and 12*b* of the barrel section 26. Thus, the bat 10 is lighter than a hickory bat, but stronger than a non-hickory bat. Any other combination of woods yielding the desired characteristics is possible.

In addition to their mechanical properties, the woods used in the bat 10 may be chosen for an attractive or distinctive appearance, or the woods may be stained for the same effect. For example, sapele is a dark wood, similar to mahogany, but hickory is a light-colored wood, so that the combination yields a striking and unusual impression on the eye. A light-colored wood, such as ash or maple, could also be chosen in place of the sapele to give a more conventional looking bat, or the hickory could be stained to match the sapele, yielding a dark but single-colored bat. In the event that two woods of similar colors are chosen for their mechanical properties, the appearance of the hickory-sapele combination can also be simulated by the careful application of stain.

Figure 2:
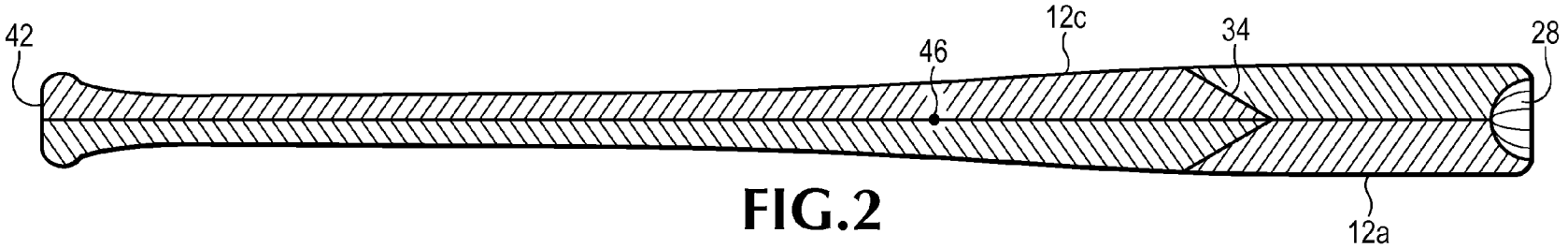
FIG. 2 is a cross-section along the line 2-2 of FIG. 1, showing the internal composition of the bat and the cup-shaped hollow at the end.
Figure 4:
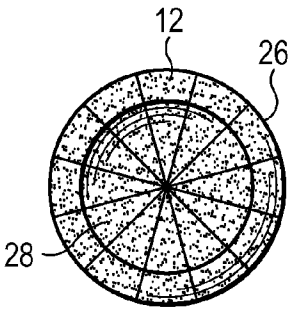
FIG. 4 is a plan view of the top, or barrel end, of the exemplary embodiment.
Figure 3:
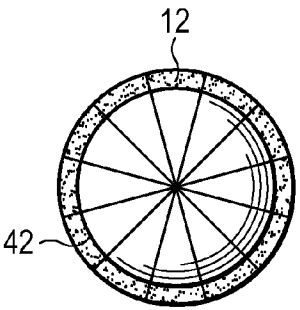
FIG. 3 is a plan view of the bottom, or knob end, of the exemplary embodiment.

In a two-wood bat, the two different woods should be joined securely to make a bat capable of withstanding the enormous stress of striking a fastball. This may be accomplished by a longitudinally overlapping arrangement of the battens as shown in FIGS. 1, 5, and 6. In this arrangement, the shortest and longest battens 12*a* and 12*c* are aligned with each other, and the remaining battens 12*b* and 12*d* are aligned with each other. In addition, a miter cut may be made on the adjoining ends of all battens to increase the glue-coated area of the joint 34 as shown in FIG. 2. One of the battens in an aligned pair can receive an acute angle miter cut, preferably about 30 degrees relative to the axis 48 as shown in FIG. 2, while the corresponding batten will receive a supplementary angle cut for a close fit. Preferably, this cut is made so that the longer portion of the lower batten 12*c* or 12*d* comprising the handle 24 is located near the axis, while the longer portion of the upper batten 12*a* or 12*b* comprising the barrel 26 is towards the outside of the bat, as shown in FIG. 2. In this way, a ball striking the bat 10 tends to put a compressive, rather than tensile, stress on the glue joint.

After cutting, the sets of battens may be weighed and paired for balance, as in the single-wood bat. The faces 32 are then coated with glue, and the bat is assembled as before, except that in place of a single batten running the full length of the bat, each layer comprises a pair of battens, meeting at joints 34, as best shown in FIGS. 2 and 5. The lengths of the upper and lower battens are alternated, such that when one batten pair is comprised of a shorter handle batten 12*d* and a longer barrel batten 12*b*, the next layer will be comprised of a longer handle batten 12*c* and a shorter barrel batten 12*a*. In this way the joints 34 are offset longitudinally, yielding a stronger bat, but the blank 30 is still unitary and solid, without air gaps.

When the blank 30 has been assembled, it is wrapped in a barrier material and clamped with hose clamps. In addition, a clamp may be applied to press the ends of the blank 30 together, forcing the mitered joints 34 of the battens into close contact. Bar clamps of suitable length are well known to those skilled in the art. The blank 30 is then allowed to cure and machined to form the bat 10.

In the preferred embodiment, the handle 24 is constructed from hickory and the barrel 26 is constructed of sapele. The densities of these woods, given in ounces per cubic inch, are about 0.45 to 0.55 for hickory, and about 0.35 to 0.37 for sapele. Hickory is unusually strong, with an impact bending strength above 55 inches for most species and as high as 104 for one, when tested in accordance with ASTM D143-94 (2007), §10. Other woods such as ash, maple, or birch, are significantly less resistant to impact, with most species having impact bending strengths below 40 and none being higher than 60 inches. Ash, maple, and birch may also be employed for the barrel, but with densities ranging from 0.38 to 0.41 oz/cu inch, they do not give as desirable a swing weight as sapele, which combines high hardness and shear strength with its lower density. The all-sapele barrel portion 36 (FIG. 1) comprises about 24+/−10% of the length of the bat, the overlapping joint portion 38 comprises about 16+/−10%, and the all-hickory handle portion 40 comprises about 60+/−10%. The mid-spec values for these lengths and densities yields a bat with its center of gravity 46 (FIG. 2) about 62% of the distance from the end of the knob 42 to the end 44. This results in a moment of inertia that is comparable to a conventional bat cut from a single blank of maple, despite higher overall weight and higher strength. In addition, due to the use of hickory and the symmetrical arrangement of the grain lines 16 in the laminated design of the preferred bat, its propensity to break is greatly reduced. Finally, when the bat of the present invention does break, it is less likely to do so catastrophically, sending heavy and sharp pieces of bat through the air. More typically, a few battens will break, leaving the remaining battens to hold the bat in one piece, improving player and spectator safety.

The precise final dimensions and woods are chosen with two main goals in mind. First, the bat preferably should have a moment of inertia, and therefore a "swing weight," comparable to wooden bats of the same size which are already in common use. The moment of inertia may be varied by varying the density of the woods involved and their distances from the knob 42—higher densities and higher distances yielding higher moments. A further means of controlling swing weight is changing the lengths of the respective sections, to alter the quantity of low-density wood in the bat. In addition, it is not necessary to make an entire section out of a single wood; some of the battens in a given section could be made of one type of wood, while others were made of another. For instance, including a few hickory battens in the barrel along with the sapele already present would increase the swing weight of the bat, which some batters might find preferable. Regardless of how the adjustment is made, when a greater proportion of the barrel is composed of a lighter wood, and/or the center of gravity 46 is moved towards the knob 42, the moment of inertia will be lower, and vice versa. The second goal is structural integrity. When a bat strikes a baseball, temporary forces as high as 8,000 pounds per square inch are encountered. The result is bat vibration, invisible to the unaided eye, but visible on high-speed video or stroboscopic photographs. The joint portion of the bat, where the two woods overlap, should not cover an area of the bat that experiences the sharpest bends; rather, that area is preferably entirely hickory, to take advantage of hickory's very high strength. The wood choices, densities, and proportions as given above for the preferred embodiment satisfy both of these criteria, but other combinations are possible.

An additional embodiment features some number of the battens 12 which run the entire length of the bat. This provides additional structural integrity and also offers another way of adjusting a bat's swing weight and overall weight. In a preferred version of this embodiment, the bat is made from a total of twenty-one battens 12, of which twelve are hickory and nine are sapele. Three of the hickory battens 12*e*, placed at 120 degree intervals around the bat axis 48, run the entire length of the bat to impart additional strength and durability. The increased density of hickory will also increase the swing weight. Different total numbers of battens 12, and different numbers of full length battens 12*e*, may be employed for different purposes. For instance, bats intended to be swung by larger and stronger hitters, or at balls pitched at higher speeds, may benefit from having more full-length hickory battens 12*e*. Bats intended for smaller hitters or children's leagues, which place less stress on the bat and also call for lower swing weights, may have fewer.

Figures 13, 14, 15:
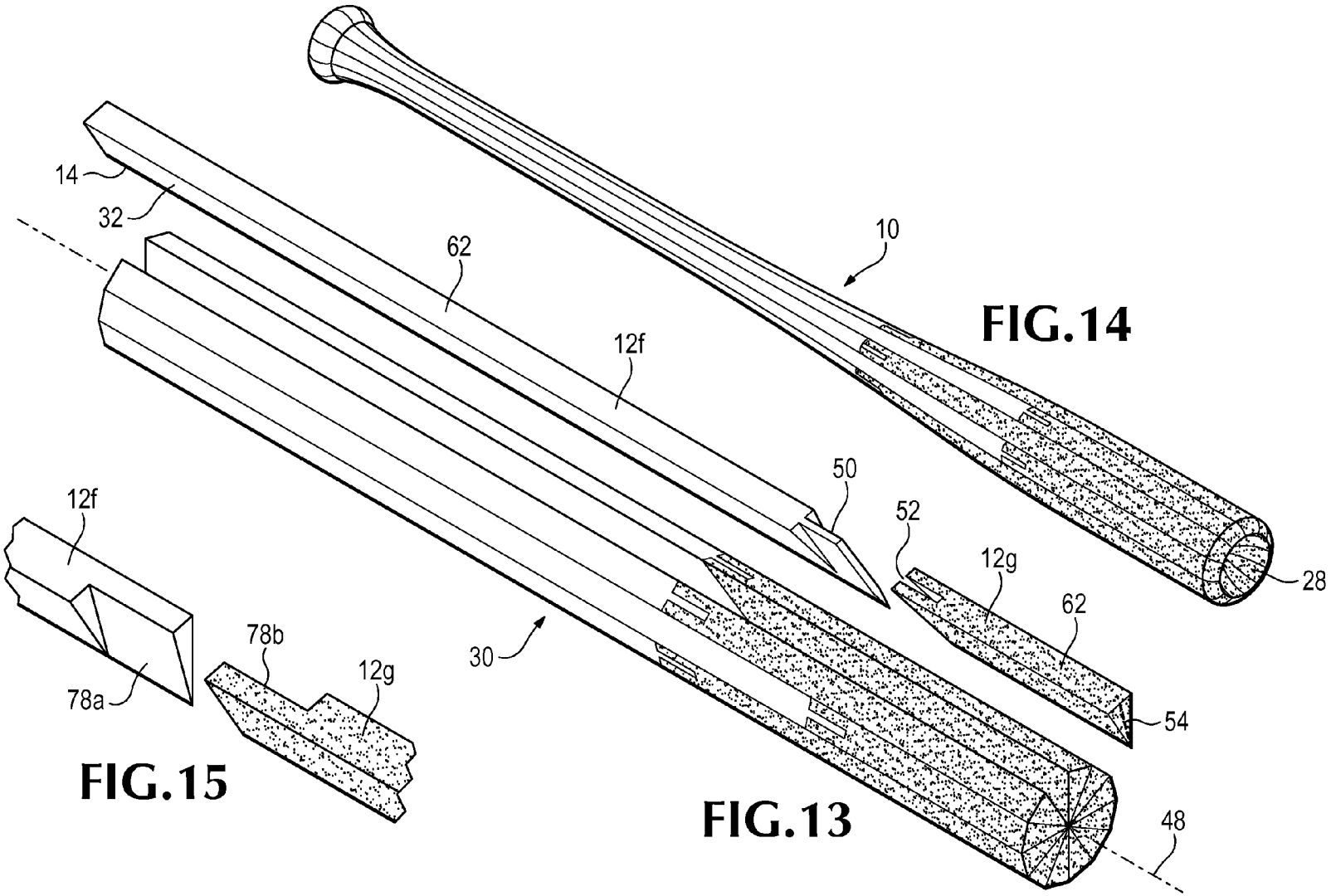
FIG. 13 is a partially exploded perspective view of an approximately cylindrical blank that is to be machined into an alternative embodiment, showing the composition of the blank and the joint between battens of different types.
FIG. 14 is a perspective view of an alternative embodiment.
FIG. 15 is a detail view of an alternative embodiment of the joint between battens.
Figure 16:
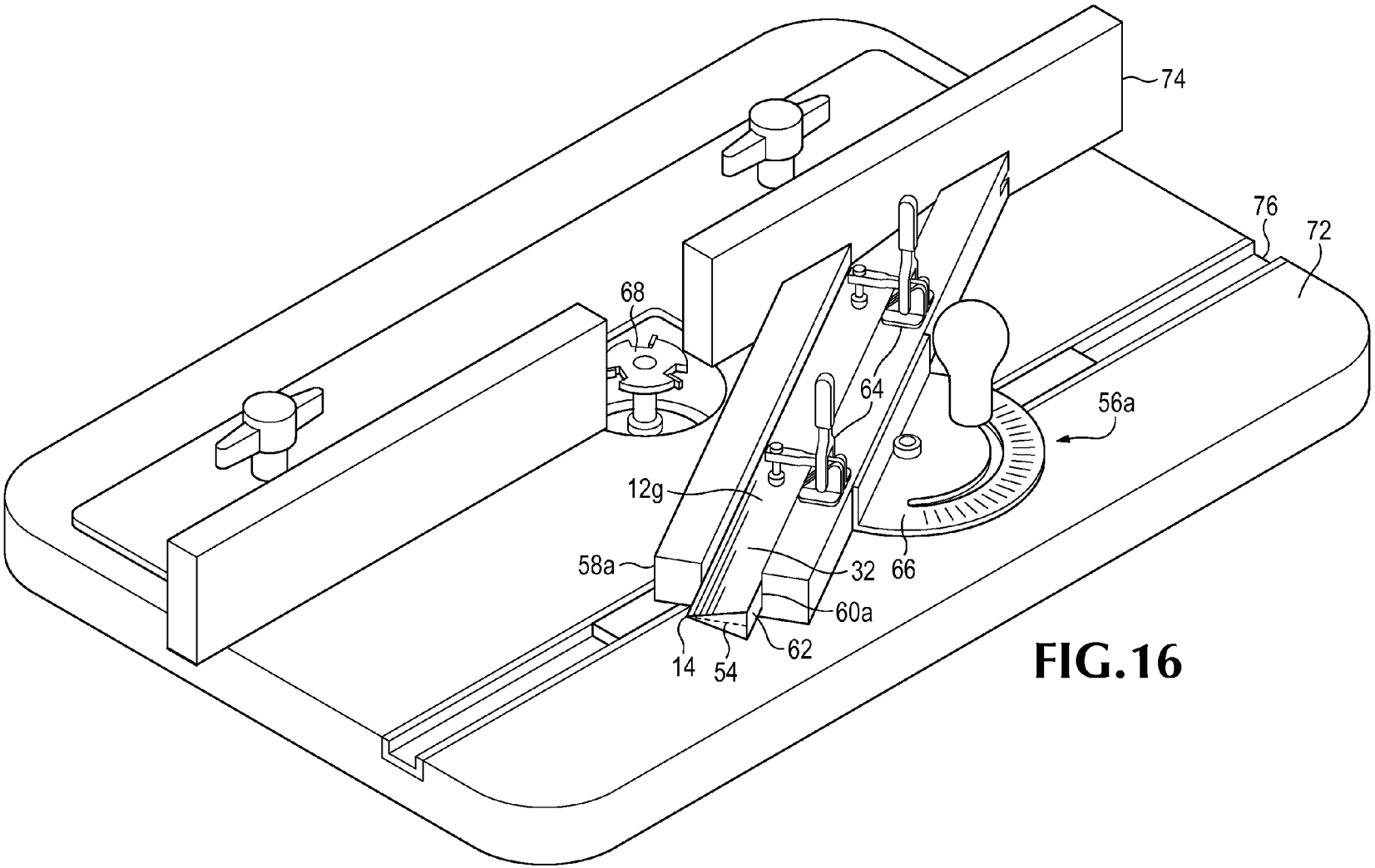
FIG. 16 is a perspective view of the apparatus used for cutting a groove in the end of a batten.
Figure 18:
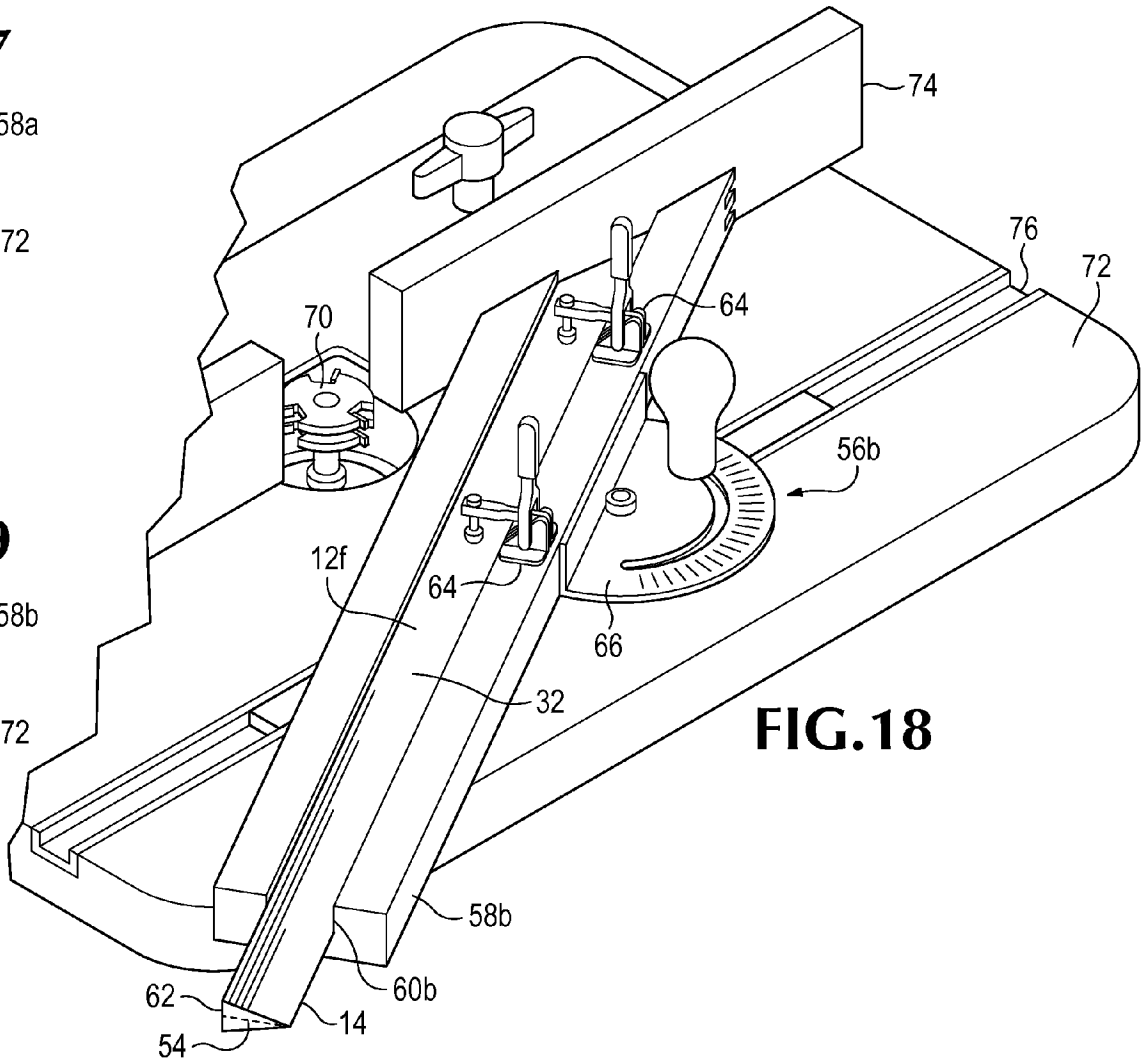
FIG. 18 is a perspective view of the apparatus used for cutting a tongue in the end of a batten.
Figure 17:
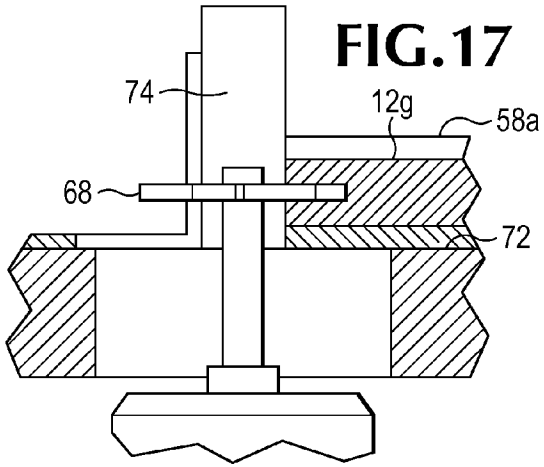
FIG. 17 is a sectional view of a groove being cut by the apparatus shown in FIG. 16.
Figure 19:
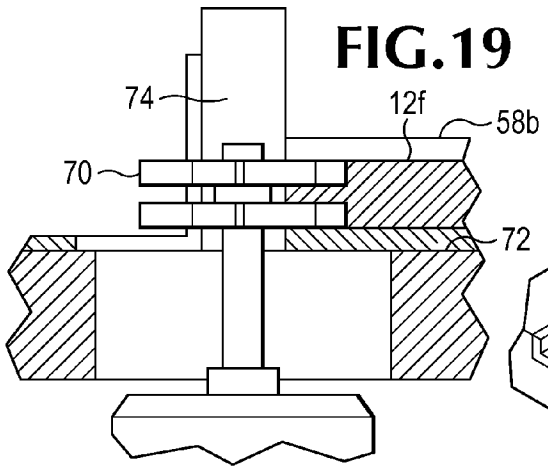
FIG. 19 is a sectional view of a tongue being cut by the apparatus shown in FIG. 18.

Another additional embodiment features a reinforced joint between battens 12*f* and 12*g*, as best shown in FIGS. 13 and 14. To further assist the bat in resisting the bending forces caused by ball impact, a tongue 50 may be machined into the end of batten 12*f*. It is mated to a groove 52 in batten 12*g*, such that very little gap exists over the contact area between the battens. This arrangement greatly increases the surface area over which the glue can bond, and results in greater strength both in tension and in shear.

The tongue 50 and groove 52 are both preferably formed along the centerline 54 of the batten such that an equal amount of batten is found on either side of the tongue 50 or groove 52. Additionally, as discussed above, the battens 12 preferably meet at an angle other than perpendicular. Therefore, jigs 56*a* (groove) and 56*b* (tongue) are required to support the battens 12 during cutting operations. These are depicted in FIGS. 14-15. The jigs 56*a* and 56*b* comprise blocks 58*a* (groove) and 58*b* (tongue) constructed of a suitable hard plastic material, which is easily molded or machined to the appropriate shape. Blocks 58 made of wood or metal are also possible, although they are neither as easily made nor as dimensionally stable. The blocks 58*a* and 58*b* have a substantially rectangular cross-section, in which recesses 60*a* and 60*b* are cut. The recesses 60*a* and 60*b* are the appropriate width to hold battens 12*f* and 12*g* securely and with minimal movement. The recesses 60*a* and 60*b* are sloped so that when a batten 12 is placed in it, the centerline 54 of the batten 12, which is drawn from the vertex 14 to the outer edge 62, always halfway between the faces 32, is horizontal. This shape ensures that the tongue 50 or groove 52 will be cut along the centerline 54 and the resulting batten 12 will be symmetric about a plane defined by the tongue 50 or groove 52. The batten 12 may be held in position by clamps 64. The blocks 58*a* and 58*b* are mounted to miter gauge 66, which is used to control the angle of cut.

Cutting of the tongue 50 or groove 52 is accomplished by purpose-build router bits 68 (groove) and 70 (tongue) mounted on a conventional router (not shown) set in an ordinary router table 72. A conventional fence 74 may be used to control the depth of cut. The miter gauge 66 may be set into the slot 76 on the router table 72 with the jig attached to it, to control the angle of cut. When the batten 12 is clamped to the block 58*a* or 58*b*, the block 58*a* or 58*b* attached to the miter gauge 66, and miter gauge 66 placed into the slot 76 on the router table 72, the batten 12 is held securely at an appropriate angle and depth of cut, so that the tongue 50 and groove 52 will be cut cleanly and will mate tightly after cutting.

Another embodiment features a lap joint between the battens 12, as best shown in FIG. 15. Instead of featuring a tongue and groove arrangement, half of each batten 12 is simply machined away at the end, leaving joint halves 78*a* and 78*b*, and permitting an overlap between the battens where they join. A lap joint may be made using the same jigs 56 and blocks 58 as are used for the tongue and groove embodiment. The cutter 68 of the router should be adjusted to remove half of the batten 12 being cut, up to the centerline 54, to allow for a smooth connection between battens 12 after gluing. While it is possible to cut somewhere other than the centerline 54, resulting in, for example, a 60/40 lap joint, such a joint is weaker.

The terms and expressions that have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

What is claimed is:

1. A bat comprising an elongate composite wooden structure, said structure comprising:

(a) a first wooden batten formed from a first wood species having a first end, said first end comprising a tongue; and (b) a second wooden batten formed of a second wood species having a second end, said second end defining a groove so configured as to mate with said tongue;

(c) wherein said first and second ends are closely adjacent and said tongue closely adjacent said groove; and (d) wherein said elongate composite wooden structure has a longitudinal direction and is tapered transverse to said longitudinal direction to form an elongate wedge.

2. The bat of claim 1 wherein a handle of the bat is formed of the first wood species and a barrel of the bat includes the second wood species.

3. The bat of claim 2 wherein the first wood species has a density of about 0.45-0.55 ounces per cubic inch and the second wood species has a density of about 0.35-0.37 ounces per cubic inch.

4. The structure of claim 1 wherein said first and second ends are cut at supplementary angles to one another.

5. The structure of claim 4 wherein said first and said second ends are not perpendicular to said longitudinal direction.

6. The structure of claim 1 wherein said tongue defines a plane, and said structure is symmetric about said plane.

7. The structure of claim 1 wherein said second end defines a recess into which said tongue is received.

8. A bat comprising an elongate wooden structure having a substantially uniform cross-section over its entire length, said structure comprising:

(a) a first wooden batten having a first end;

(b) a second wooden batten having a second end; and (c) a mating section wherein said first end and said second end overlap in a longitudinal direction;

(d) wherein said substantially uniform cross-section is triangular.

9. The structure of claim 8 wherein said mating section is a lap joint.

10. The structure of claim 8 wherein said mating section is a tongue and groove joint.

11. A wooden bat having a longitudinal axis and a length, said bat comprising:

(a) a first set comprising a plurality of elongate battens running longitudinally and disposed substantially cylindrically symmetrically about said axis; and (b) a second set comprising a plurality of elongate battens running longitudinally and disposed substantially cylindrically symmetrically about said axis, at least one batten in said second set being combined into a pair with at least one batten in said first set such that the pair extends over the entire length of the bat;

(c) wherein said pair of battens meets at a tongue and groove joint.

12. The bat of claim 11 wherein said first set is composed of a first wood species and said second set is composed of a different wood species.

13. The bat of claim 11 wherein at least one of said first set of battens extends the entire length of the bat.

14. The bat of claim 11 wherein said first and second sets have the same number of battens and each batten in said first set forms a pair with one batten in said second set.

15. A wooden bat, comprising:

a. a first section including a handle; and b. a second section including a barrel; wherein, c. said first and second sections each contain respective cylindrical portions and respective joint portions;

d. said cylindrical portions are substantially cylindrically symmetrical about a longitudinal axis of said bat and so constructed as to be substantially free of air gaps;

e. said respective joint portions each comprise wedges of wood arranged about said axis, each of said wedges having two longitudinally extending sides converging radially onto said axis, at least two of said wedges being separated from one another by a wedge-shaped space; and f. said respective joint portions being so constructed as to join matingly with each other, with the wedges from said handle section filling the spaces between the wedges of said barrel section, and vice versa, so that the sections, when joined, create a substantially solid bat.

* * * * *